United States Patent [19]

Leyden

[11] 4,455,464

[45] Jun. 19, 1984

[54] ALARM SYSTEM SENSING AND TRIGGERING APPARATUS

[75] Inventor: Roger J. Leyden, Willow Springs, Ill.

[73] Assignee: Se-Kure Controls, Inc., Chicago, Ill.

[21] Appl. No.: 402,372

[22] Filed: Jul. 27, 1982

[51] Int. Cl.[3] ..... G08B 21/00; H01H 3/02

[52] U.S. Cl. ..... 200/61.93; 200/85 R; 200/52 R; 340/626

[58] Field of Search ..... 200/52 R, 61.04, 61.06, 200/61.93, 83 N, 85 R; 340/572, 626

[56] References Cited

U.S. PATENT DOCUMENTS 3,932,857 1/1976 Way et al. ..... 340/626

4,005,296 1/1977 Olson ..... 200/85 R

*Primary Examiner*—J. R. Scott

*Attorney, Agent, or Firm*—Dick and Harris

[57] ABSTRACT

An improved alarm system sensing and triggering apparatus for remote detection of interruptions or alterations in an otherwise closed electrical alarm circuit. Exposed electrodes are embedded together with a substantially deformable current conducting element in a recessed housing cavity. The conducting element is compressable or deformable, momentarily, to an altered shape to activate the alarm system without the need for partially or completely detaching the sensor itself from the article to which it is connected. The recessed cavity together with the exposed electrodes and deformable conducting means cooperate with the sensor housing and alarm system integration conductors and with sensor attachment devices to provide the improved security features.

10 Claims, 7 Drawing Figures

ALARM SYSTEM SENSING AND TRIGGERING APPARATUS

BACKGROUND OF THE INVENTION

The present invention relates in general to security alarm and anti-theft devices and in particular to an improved alarm system sensing and triggering apparatus for direct attachment to an article to remotely detect an interruption or alteration in either the position of the article or the state or shape of the sensing device.

In recent years retail and wholesale merchandisers have directed substantial attention to the nagging and costly problem associated with the theft and/or damage of costly display products on their premises. Indeed, with the advent of smaller and more portable electronic apparata, the ease with which pilferers and shoplifters can quickly and easily remove such goods from display cases and display racks has intensified. At the same time the availability of new products such as video cassette recorders, small portable radios and televisions, calculators and the like has skyrocketed, resulting in more and more valuable products being taken or tampered with without authorization, at an outstanding rate.

Among the more conventional devices addressed to the problem of integrating the physical surfaces of such articles into an alarm system have been the alarm system sensing devices described in U.S. Pat. Nos. 3,932,857 of Way et al. and 4,000,488 of Ephraim. While these devices secure, in various conventional ways, an electrical alarm sensor to an article, they require the actual "clean" breakage or complete detachment of the sensor device from the article to trigger the associated alarm system integrated electrically with the sensing device. Products, such as those exemplified by the prior art references as well as other conventional devices, fail to address the problem of unauthorized tampering with the sensing device falling short of complete, clean detachment of the sensing device itself.

As products, display cases, display racks, locks and other security devices have become more sophisticated, so too have the individuals and methods for circumventing the operation of conventional security apparata and particularly alarm sensing devices. For example, conventional sensor devices have fallen prey to individuals who realize that artful replacement of an exposed or otherwise slidable conducting means utilized in such devices by alternative conducting means, such as a small electrical conducting plate, can circumvent the alarm system resulting in the theft of the "protected" article. Mass merchandisers often end up returning to a display case or rack only to find the otherwise "reliable" alarm sensor waylaid by a short circuiting plate, which was effeciently shifted into position to replace the closed circuit conductor previously attached (or which may still be attached) to the article stolen just minutes earlier.

It is thus an object of the present invention to provide an alarm system sensing and triggering device which is capable of signalling outright theft of an article and/or tampering with the sensing device itself by triggering an alarm system upon actual detachment of the sensing device from the article or upon the unauthorized tampering or handling of the sensing device prior to its attempted detachment from the article.

It is additionally an object of the present invention to provide such an alarm system sensing and triggering device which is both easy to install to a device so as to promote its actual adoption, use and application to a myriad of articles on display—one which is nonetheless reliable yet relatively inexpensive to manufacture and reasonably priced.

It is yet a further object of the present invention to provide a sensing or triggering apparatus which utilizes an electrode conducting element which is maintained in an embedded fashion within the sensing device housing itself so as to preclude the facilitated substitution of the device with an overriding conducting means by an individual attempting to damage, steal or otherwise affect the value of the article without authorization.

These and other objects of the invention shall become apparent in light of the foregoing specification.

SUMMARY OF THE INVENTION

The present invention comprises an improved alarm system sensing and triggering apparatus for remote detection of interruptions or alterations in an otherwise closed electrical circuit. The apparatus is one component part of an overall alarm system utilized by retail stores, for example, wherein articles to be protected against tampering and/or theft are integrated into an alarm circuit path through the attachment of such a sensor. The sensor is affixed through the direct attachment of the sensor housing means to the article and is integrated into the overall alarm system through alarm system integration means emanating from the first end of the sensor housing.

Emanating from the second end of the sensor housing are exposed electrode means which are electrically connected to the integration means. Current conducting means are attached to the article along a first side so as to operably communicate with the exposed electrode means along the second side of the current conducting means, to alternatively close and open an electrical circuit defined between the electrodes and the current conducting member when the conducting means is operably interposed between the electrodes and the article itself. Through such an arrangement disturbance of the position of the current conducting means affects the electrical circuit by opening same to activate the alarm system.

Sensor attachment means are utilized to attach the periphery of the sensor housing to the article with the current conducting means operably interposed between the exposed electrodes and the article itself. Recessed cavity means are located at the first end of the sensor housing for operable receipt of the current conductor means. The exposed electrode means itself is positioned in the lower portion of this recessed cavity and extend slightly upward into the recessed cavity portion.

The current conductor means is formed of a substantially deformable material which is compressible to a substantially reduced height upon the application of even a minimum force upon the sensor apparatus or the sensor housing itself. This substantially deformable material is capable of maintaining its compressed shape, at least momentarily, upon the release of the applied force to affect the status of the circuit formed between the exposed electrode and the current conductor means before the deformable material returns the shape of the current conductor means to its pre-compressed shape. Accordingly this deformable current conductor between the the sensor housing and the article is capable of opening the electrical circuit between the electrodes and the conductor element to trigger the alarm system upon the mere tampering with the sensing and triggering apparatus without the need for outright detachment of the sensor housing from the sensor attachment means or, in turn, the article.

In the preferred embodiment of the invention the means for integrating the sensing and triggering apparatus into the alarm system itself comprises a pair of electrical conductors emanating from the first end of the sensor housing means.

These emanating electrical conductors are connected, within the sensor housing, with the electrode means, which preferably comprises a corresponding pair of electrical conducting electrode elements emanating upwardly from the bottom of the recessed cavity means to a position immediately adjacent the bottom of the recessed cavity. Both the cavity portion and the exposed electrode means emanate from the second end of the sensor housing, at a position axially opposite the first end from which the alarm system integration means emanates.

In this preferred embodiment, the current conducting means comprises a substantially flat conducting member which is smaller in size than the innermost peripheral dimension of the recessed cavity means so as to permit telescopic receipt of this conducting member within the recessed cavity. The current conducting means includes adhesive attachment means along its first side for attachment of the conducting member to the article and further includes electrical conducting means on its second side which comprises an electrical conductor surface, such as a thin foil member, for circuit cooperation with the exposed electrode means. The second side having the electrical conductor surface is positioned axially opposite the first side possessing the adhesive means for attachment to the article. The substantially deformable material is operably interposed between the adhesive attachment means on the first side of said current conductor means and the electrical conductor surface along the second side of the current conductor means.

Preferably, the substantially deformable material comprises a substantially polyurethane charcoal polyester foam which, upon slight application of force, in part (along one side) or in whole, compresses to cause separation of the current conducting surface from one or both of the exposed electrodes in the recessed cavity means. This particular material, preferably in a two pound density, serves to permit satisfactory momentary compression before automatically restoring, through memory, to its original noncompressed state. An alternative material formed of a substantially porous plastic composition may be utilized instead.

In the preferred embodiment of the invention, additionally, the sensor attachment means for attaching the periphery of the sensor housing to the article itself comprises a substantially flat flexible attachment ring conforming in shape to that shape of the sensor housing periphery shoulder about the recessed cavity means. This attachment ring has adhesion means on both its upper and lower surfaces for attachment to the article and attachment to the sensor housing means respectively. For purposes of ease in shipment and application of all the adhesion means in the present invention, including the adhesion means on both sides of the sensor attachment ring as well as on the first side of the current conducting means, it is contemplated that such articles can be shipped with "peel-off" paper material for exposing the adhesive surfaces immediately prior to attachment of the various components.

The sensor attachment ring includes at a position radially interior to the peripherial ring portion, an orifice portion which is alignable with the recessed cavity means to permit the interpositioning therewithin of the current conducting means, in a position extending from the exposed electrodes directly to the article, without interruption. The attachment ring further cooperates with the recessed cavity in the sensor housing to accentuate the extent of the cavity for the purpose of securely maintaining the current conducting means in an unexposed position between the sensor housing and the article when the sensing and triggering device is armed for utilization with the alarm system. Additionally, this attachment ring is preferably fabricated of a partially deformable and resilient material to more readily permit the deformation of the current conducting means upon the mere tampering with the sensing and triggering apparatus so as to preclude the need for outright detachment of the sensor housing from its juxtaposed attachment ring and in turn from the article.

Preferably the entire invention including the sensor housing, the current conducting means, and the attachment ring are circular in shape, although it is contemplated that alternative geometric shapes may be utilized.

DETAILED DESCRIPTION OF THE DRAWINGS

Figure 1:
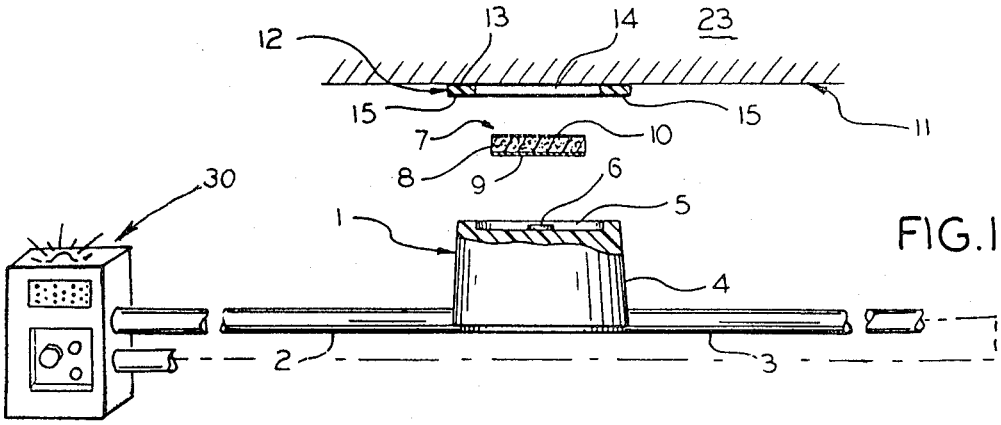
FIG. 1 of the drawings is a side elevational exploded view of the present invention showing, in part, arrangement of its component elements for attachment to an article towards prevention of theft or tampering.

While this invention is susceptible of embodiment in many different forms, there is shown in the drawings and will herein be described in detail, one specific embodiment, with the understanding that the present disclosure is to be considered as an exemplification of the principals of the invention and is not intended to limit the invention to the embodiment illustrated.

Sensing and triggering apparatus 1 is shown in FIG. 1 as comprising sensor housing 4 with recessed cavity portion 5 at its second end in which exposed electrode 6 is positioned, together with alarm systems 30. Electrical conductors 2 and 3 emanate from the first opposite side of sensor housing 4 for connecting the sensor-triggering apparatus into an overall alarm system. The overall apparatus 1 is utilized to detect its detachment from article surface 11 and trigger the alarm system, as well as to detect unauthorized tampering with the device through utilization of current conducting means 7 which is composed primarily of a sbustantially deformable material 8 which, in the preferred embodiment, comprises a substantially polyurethane charcoal polyester foam of two pound density or any alternative deformable material of a substantially porous plastic composition substance. On the upper first side of current conducting means 7 is located adhesion means 10 for direct attachment of the conducting means to the surface of article 11 within orifice 14 of sensor attachment means 12 comprising, in the preferred embodiment, a substantially circular partially deformable ring. On the other side of current conducting means 7 at its second opposite side, is electrical conducting surface 9 which cooperates with a plurality of electrodes such as electrode 6 for the purpose of maintaining a closed electrical circuit until detachment of the sensor housing or upon unauthorized tampering with the sensor device. Upon deformation and/or outright removal of electrical conducting surface 9 from its position immediately juxtaposed the exposed electrode 6, the alarm system is activated.

Attachment ring 12 with orifice 14 is maintained in position against article surface 11 of article 23 through the utilization of adhesion means 13 on the upper surface of attachment ring 12 and adhesion means 15 on the lower surface of attachment ring 12. Upon attachment of sensing and triggering apparatus 1 to article 23 along its surface 11, sensor housing 4 is adhesively attached in the position immediately juxtaposed to attachment ring 12 so as to sandwich, in an unexposed fashion, current conducting means 7 between sensor housing 4 and article surface 11 whereby current conducting means 7 is compressed into the region defined by recessed cavity 5 as extended by orifice 14 of attachment ring 12.

Figure 2:
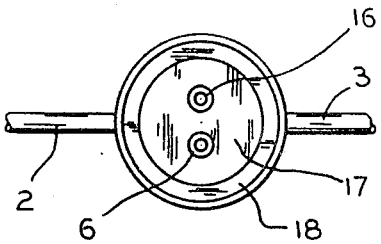
FIG. 2 is a top plan view of the first (top) side of the sensor housing.
Figure 3:
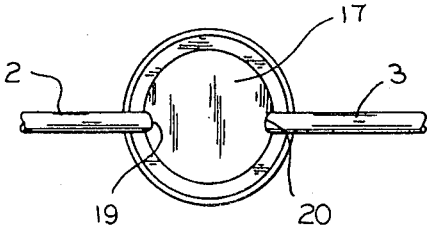
FIG. 3 is a bottom plan view of the sensor housing showing particularly the alarm system integration means emanating therefrom.
Figure 5:
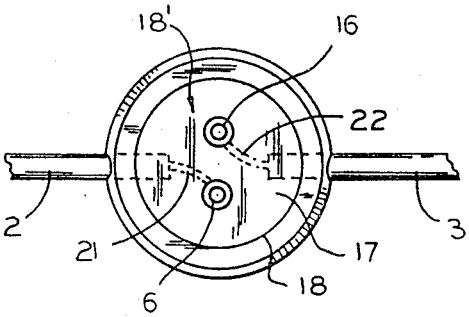
FIG. 5 is a top plan view of the sensor housing in accordance with that of FIG. 2, showing, in dotted fashion, the operable connection between the alarm system integration means and the exposed electrode means.

The top or first side of sensor housing 1 is shown in FIG. 2 as are exposed electrodes 6 and 16 rising into cavity portion 5 from a composite non-conducting material 17 which maintains electrodes 6 and 16 in position while maintaining the electrical connection of these electrodes with system integration conductors 2 and 3 respectively (as shown in dotted fashion by FIG. 5). FIG. 2 of the drawings also shows the position of sensor housing periphery 18 immediately surrounding recessed cavity means 5. In the preferred embodiment, peripheral shoulder 18 attaches directly to attachment ring 12, to in turn attach the entire sensor housing 4 and overall sensing and triggering apparatus 1 to the exposed surface 11 of article 23. Sensor housing 4 is shown in FIG. 3 with non-conducting composite material 17 and system integration conductors 2 and 3 emanating from positions 12 and 20, respectively, in the sensor housing.

Figure 4:
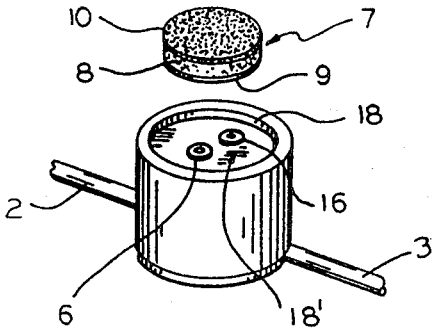
FIG. 4 is a side perspective view of the sensor housing in exploded fashion with the current conducting device positioned thereabove.

Current conducting means 7 is shown in detail in FIG. 4 as comprising adhesive surface portion 10 for attachment to article surface 11, substantially deformable material portion 8 immediately below adhesive portion 10 and electrical current conducting surface 9 which, in the preferred embodiment, comprises a foil-like material for maintaining the flow of electrical current between electrodes 6 and 16 in sensor housing 4. FIG. 4 of the drawings also shows peripheral housing shoulder 18, lower surface 18' of recessed cavity portion 5 and system integration conductors 2 and 3.

The electrical conducting arrangement whereby electrodes 6 and 16 are operably connected to conductors 2 and 3, respectively, is shown in FIG. 5 wherein intermediary electrical conductors 21 and 22 electrically connect electrodes 6 and 16 to conductors 2 and 3 respectively. This electrical connection is restrainably maintained in position within hardened composite material 17 in sensor housing 4, which composite material ends abruptly at its upper surface 18', (the lower surface of recessed cavity portion 5), with exposed electrodes 6 and 16 rising from surface 18' to provice a reasonably accessable series of contact points for cooperation with electrical conducting surface 9 on current conducting means 7.

Figure 6:
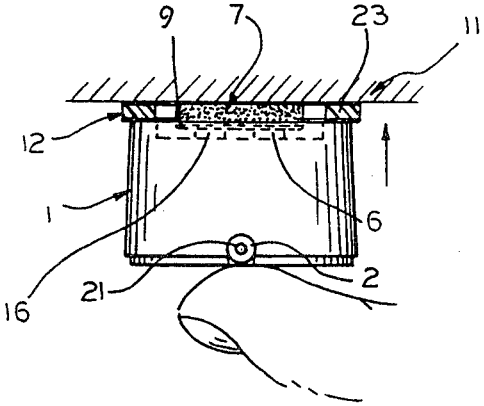
FIG. 6 is an elevational side view of the sensing and triggering apparatus in partial cross-section immediately prior to application of a "tampering" force to the sensor housing to in turn exert deformable pressure against the current conductor means.
Figure 7:
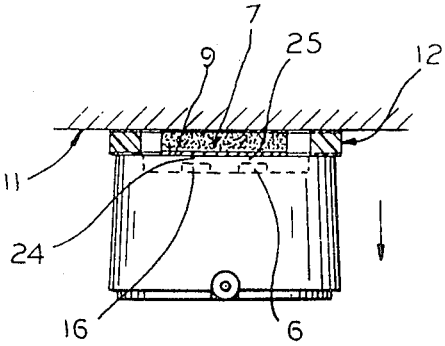
FIG. 7 of the drawings is a side elevational view in partial cross-section, consistent with FIG. 6 of the drawings, in which the substantially deformable material of said current conductor means has momentarily maintained its compressed shape to affect the electrical relationship with the exposed electrodes, thereby opening the alarm circuit to trigger same without need of actual detachment of the sensor housing from its juxtaposed attachment ring.

The means through which tampering with the sensor sets off the system without the need for outright detachment is shown in FIGS. 6 and 7. In FIG. 6 the arrangement of the component parts of the sensing and triggering apparatus are shown immediately prior to application of a tampering force exerted, by way of illustration, by a tamperer's finger. Immediately prior to the exertion of force in the direction of the arrow shown, current conducting means 7 with electrical conducting surface 9 is maintained in position directly against electrodes 6 and 16 to maintain the transfer of electrical energy therebetween. Partially deformable material 23 of attachment ring 12 permits some flexibility to in turn permit the deformation and compression of the substantially deformable material of current conducting means 7. Unauthorized tampering with the triggering and sensing device 1 or, for that matter, integration conductor element 2 immediately proximate to sensor apparatus 1 results in the immediate application of deformation to the deformable material in current conducting means 7. Upon such deformation one or more regions of current conducting means 7, as shown in FIG. 7, are compressed with the current conducting means retaining its compressed form momentarily before returning to its noncompressed state.

Electrical conducting surface 9 is thus momentarily separated from one electrode (16) by space 24 and/or the other electrode (6) by space 25 so as to affect the otherwise closed circuit relationship between conducting foil 9 and electrodes 6 and/or 16. This separation occurs before the reusable current conducting means retains its original noncompressed shape. But even such a momentary separation of one or more of the electrodes from their continuous contact with electrical conducting surface 9 is capable of setting off the alarm connected into the circuit arrangement by conductors 2 and 3. Through such a construction the sensing and triggering apparatus is capable of monitoring the articles attached to the sensing device to protect from theft or damage to such articles done by either outright removal of the sensing and triggering apparatus which time the adhesive bonds on the attachment ring would be broken, or through even minimal tampering with the sensing and triggering apparatus which, though slight, would still serve to activate the alarm system to protect the displayed article. Moreover an individual attempting to "short circuit" the sensing device would have substantial difficulty in applying a shear force to the attachment ring to "slide in" a replacement conductor since the current conducting means is now recessed in cavity portion 5 rather than being slidable out of configuration with no ridge or shoulder 18, otherwise protecting its positioning therewithin.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. An improved alarm system sensing and triggering apparatus for remote detection of interruptions or alterations in an otherwise closed electrical circuit, of the type including sensor housing means which are attachable to an article, alarm system integration means emanating from a first end of said sensor housing means for electrically connecting and integrating same into an electronic circuit embodying said alarm system, exposed electrode means electrically connected to said integration means and emanating from a second end of said sensor housing, current conducting means with a first and second side which is attachable to said article along said first side and operably communicating with said exposed electrode means along its said second side to alternatively close and open an electrical circuit defined therebetween when said conducting means is operably interposed between said exposed electrode means and said article, whereby disturbance of the position of said current conducting means affects said electrical circuit to activate said alarm system, said sensor attachment means for attaching the periphery of said sensor housing to said article with said current conducting means operably interposed between said exposed electrode means and said article, said improvement comprising;

recessed cavity means at said first end of said sensor housing for operably receipt of said current conducting means, said exposed electrode means being positioned in the lower portion of said recessed cavity means and extending upwardly thereinto;

said current conducting means formed of a substantially deformable material which is compressable to a substantially reduced height upon application of a substantially minimal force upon said sensor housing;

said substantially deformable material being additionally capable of further maintaining said compressed shape at least momentarily upon release of said applied force to affect the electrical status of said electrical circuit formed between said exposed electrode means, before said current conductor means returns to its precompressed shape between said sensor housing and said article to in turn open said electrical circuit towards triggering said alarm system upon the mere tampering with said sensing and triggering apparatus without the need for outright detachment of said sensor housing means from said sensor attachment means and in turn said article.

2. An improved alarm system sensing and triggering apparatus for remote detection of interruptions or alterations in an otherwise closed electrical circuit, of the type including sensor housing means which are attachable to an article, alarm system integration means emanating from a first end of said sensor housing means for electrically connecting and integrating same into an electronic circuit embodying said alarm system, exposed electrode means electrically connected to said integration means and emanating from a second end of said sensor housing, current conducting means with a first and second side which is attachable to said article along said first side and operably communicating with said exposed electrode means along its said second side to alternatively close and open an electrical circuit defined therebetween when said conducting means is operably interposed between said exposed electrode means and said article, whereby disturbance of the position of said current conducting means affects said electrical circuit to activate said alarm system, and sensor attachment means for attaching the periphery of said sensor housing to said article with said current conducting means operably interposed between said exposed electrode means and said article, said improvement comprising;

recessed cavity means at said first end of said sensor housing for operable receipt of said current conducting means, said exposed electrode means being positioned in the lower portion of said recessed cavity means and extending upwardly thereinto;

said current conducting means formed of a substantially deformable material which is compressable to a substantially reduced height upon application of a substantially minimal force upon said sensor housing;

said substantially deformable material being additionally capable of further maintaining said compressed shape at least momentarily upon release of said applied force to affect the electrical status of said electrical circuit formed between said exposed electrode means, before said current conductor means returns to its precompressed shape between said sensor housing and said article to in turn open said electrical circuit towards triggering said alarm system upon the mere tampering with said sensing and triggering apparatus without the need for outright detachment of said sensor housing means from said sensor attachment means and in turn said article;

said means for electrically connecting and integrating said sensing and triggering apparatus into an electronic circuit embodying said alarm system comprising a pair of electrical conductors emanating from said first end of said sensor housing means.

3. The invention according to claim 2 in which said exposed electrode means comprises a pair of electrical conducting electrode elements emanating upwardly from the bottom of said recessed cavity means to a position immediately adjacent thereto, said cavity portion and said exposed electrode means emanating from said second end of said sensor housing at a position substantially opposite said first end.

4. The invention according to claim 2 in which said current conducting means comprises;

a substantially flat conducting member being generally smaller in size than the inner periphery of said recessed cavity means so as to be telescopically received therewithin and including adhesive attachment means along said first side for attachment of said conducting member to said article, electrical conducting means comprising an electrical conductor surface along said second side for electrical cooperation with said exposed electrode means;

said second side being opposite said first side of said current conducting means, said substantially deformable material being operably positioned between said adhesive attachment means and said conductor surface.

5. The invention according to claim 4 wherein said substantially deformable material comprises a substantially polyurethane charcoal polyester foam.

6. The invention according to claim 4 wherein said deformable material comprises a substantially porous plastic composition substance.

7. The invention according to claim 2 in which said sensor attachment means for attaching the periphery of said sensor housing to said article comprises;

a substantially flat flexible attachment ring conforming in shape to the shape of the sensor housing periphery surrounding said recessed cavity means;

said attachment ring having adhesion means on both said upper and lower surfaces for attachment to said article and said periphery of said sensor housing means, respectively.

8. The invention according to claim 7 wherein said sensor attachment means further comprises an orifice portion interior to said attachment ring, said orifice being alignable with said recessed cavity means to permit the interpositioning therewithin of said current conducting means in a position extending from said exposed electrode means directly to said article without interruption, said attachment ring further cooperating with said recessed cavity means to accentuate the extent of said cavity means for the unexposed secure maintenance of said current conducting means between said sensor housing means and said article when said sensing and triggering device is armed for utilization with said alarm system.

9. The invention according to claim 8 in which said attachment ring is fabricated of a partially deformable and resilient material to more readily permit the deformation of said current conducting means upon said mere tampering with said sensing and triggering apparatus without the need for outright detachment of said sensor housing means from said attachment ring and in turn said article.

10. The invention according to claim 2 wherein said sensing and triggering apparatus is substantially circular in shape.

* * * * *

UNITED STATES PATENT AND TRADEMARK OFFICE

CERTIFICATE OF CORRECTION

PATENT NO. : 4,455,464

DATED : June 19, 1984

INVENTOR(S) : Roger J. Leyden

It is certified that error appears in the above-identified patent and that said Letters Patent is hereby corrected as shown below:

| | |
|---|---|
| Col. 5, line 6 | "systems" should be instead -- system --. |
| Col. 7, line 34 | "said sensor" should be instead -- and sensor --. |

Signed and Sealed this

*Sixteenth* Day of *April 1985*

[SEAL]

*Attest:*

DONALD J. QUIGG

*Attesting Officer*

*Acting Commissioner of Patents and Trademarks*